US012662216B1

(12) United States Patent
Fenker et al.

(10) Patent No.: US 12,662,216 B1
(45) Date of Patent: Jun. 23, 2026

(54) PONTOON BOAT HAVING INNER PONTOON WITH STADIUM SHAPE

(71) Applicant: Brunswick Corporation, Mettawa, IL (US)

(72) Inventors: Aaron T. Fenker, Fort Wayne, IN (US); Surinder Pal Singh, Fort Wayne, IN (US); Brian W. Miller, Fort Wayne, IN (US)

(73) Assignee: Brunswick Corporation, Mettawa, IL (US)

( * ) Notice: Subject to any disclaimer, the term of this patent is extended or adjusted under 35 U.S.C. 154(b) by 802 days.

(21) Appl. No.: 17/968,478

(22) Filed: Oct. 18, 2022

(51) Int. Cl.
*B63B 1/12* (2006.01)
*B63B 1/20* (2006.01)
*B63H 20/02* (2006.01)

(52) U.S. Cl.
CPC ..... *B63B 1/125* (2013.01); *B63B 1/20* (2013.01); *B63H 20/02* (2013.01)

(58) Field of Classification Search
CPC ..... B63B 1/12; B63B 1/121; B63B 1/125; B63B 1/20; B63B 35/34
USPC ..... 114/61.1, 292
See application file for complete search history.

(56) References Cited

U.S. PATENT DOCUMENTS

| | | | | |
|---|---|---|---|---|
| 3,064,611 | A * | 11/1962 | Engle | B63B 1/40 114/292 |
| 6,477,969 | B2 * | 11/2002 | Schell-Tomczak | B63H 20/06 440/49 |
| 7,739,975 | B1 * | 6/2010 | Manderfeld | B63B 3/12 114/356 |
| 9,517,819 | B2 * | 12/2016 | Souter | B63B 34/56 |
| 10,953,955 | B1 | 3/2021 | Fieldhouse et al. | |
| 11,091,234 | B1 | 8/2021 | Rose et al. | |
| 11,312,450 | B1 | 4/2022 | Rose et al. | |
| 2009/0031939 | A1 | 2/2009 | Fishburn | |
| 2014/0209005 | A1 * | 7/2014 | Ford | B63B 35/34 114/267 |
| 2021/0024183 | A1 | 1/2021 | Dinninger et al. | |
| 2021/0061416 | A1 | 3/2021 | Neibert | |

* cited by examiner

*Primary Examiner* — Daniel V Venne
(74) *Attorney, Agent, or Firm* — Andrus Intellectual Property Law, LLP

(57) ABSTRACT

A pontoon boat has a port pontoon, a starboard pontoon, and an inner pontoon located laterally between the port pontoon and the starboard pontoon, wherein each of the port pontoon, the starboard pontoon and the inner pontoon comprises a cylindrical body portion which longitudinally extends between a forward end and a rearward end. The inner pontoon has a rear end portion which longitudinally extends from a frontmost end to a rearmost end, the rear end portion having a length in the longitudinal direction, a width in the lateral direction, and a height in the vertical direction. As viewed in a plane defined by the lateral and vertical axes, the rear end portion gradually transitions along the length from a circular shape to a stadium shape, and the height of the rear end portion remains constant along an entirety of the length.

20 Claims, 8 Drawing Sheets

PONTOON BOAT HAVING INNER PONTOON WITH STADIUM SHAPE

FIELD

The present disclosure relates to pontoon boats and pontoons for pontoon boats.

BACKGROUND

The following U.S. Patents provide background and are incorporated herein by reference.

U.S. Pat. No. 11,312,450 discloses a floatation system for a marine vessel with a starboard pontoon, a port pontoon, and a center pontoon positioned therebetween. Outer strakes each extending along an outer length between forward and aft ends, each having an outer surface at an outer angle from a horizontal plane and an inner surface at an inner angle from the horizontal plane, and each being coupled to one of the starboard pontoon and the port pontoon. Inner strakes each extending along an inner length between forward and aft ends, each having an outer surface at an outer angle from a horizontal plane and an inner surface at an inner angle from the horizontal plane, and each being coupled to the center pontoon.

U.S. Pat. No. 11,091,234 discloses a floatation system for a marine vessel having a deck. The floatation system includes three pontoons each having a cylindrical body portion extending between forward and aft ends. The three pontoons include a starboard pontoon, a port pontoon, and a center pontoon positioned therebetween. Support members are coupled to the deck and to the three pontoons such that the three pontoons are interposed. Outer strakes each having a tip and an elongated portion, the elongated portions each extending along an outer length between forward and aft ends, are each coupled to one of the starboard pontoon and the port pontoon. Inner strakes each having a tip and an elongated portion, the elongated portions each extending along an inner length between forward and aft ends, are each coupled to the center pontoon. The aft ends of the outer strakes are aft of the aft ends of the inner strakes.

U.S. Pat. No. 10,953,955 discloses a vessel having a stern and a bow, a deck having a top surface and a bottom surface; a first outer pontoon, a second outer pontoon, a central pontoon, and the motor pod each disposed below the deck and mounted to the bottom surface of the deck. The central pontoon is disposed between the first outer pontoon and the second outer pontoon, wherein the outer pontoons are spaced apart. The motor pod is disposed behind the central pontoon and between the first outer pontoon and the second outer pontoon. The motor pod defines a running surface, wherein the vessel is capable of planing on the running surface. The motor pod supports a motor at the rear. The vessel provides the ride characteristics and stability of a pontoon-style vessel at rest and at lower speeds while also providing the performance, maneuverability, and turning radius characteristics of a V-hull sport boat.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In exemplary embodiments herein disclosed, a pontoon boat has a port pontoon, a starboard pontoon, and an inner pontoon located laterally between the port pontoon and the starboard pontoon, wherein each of the port pontoon, the starboard pontoon and the inner pontoon comprises a cylindrical body portion which longitudinally extends between a forward end and a rearward end. The inner pontoon has a rear end portion which longitudinally extends from a frontmost end to a rearmost end, the rear end portion having a length in the longitudinal direction, a width in the lateral direction, and a height in the vertical direction. As viewed in a plane defined by the lateral and vertical axes, the rear end portion gradually transitions along the length from a circular shape to a stadium shape, and the height of the rear end portion remains constant along an entirety of the length.

The rear end portion may have a planar bottom surface extending parallel to the longitudinal axis thereby providing a constant running surface in water. The cylindrical body portion of the inner pontoon may have a height which is constant along an entire length thereof, and the cylindrical body portion of the inner pontoon and the rear end portion may have bottom surfaces which are coplanar. The rear end portion may have a width in the lateral direction which gradually increases along an entirety of the length.

A mounting plate may be located on the rearmost end of the rear end portion, the mounting plate being configured to support a marine drive for propelling the pontoon boat in water. A marine drive may be mounted to the mounting plate. The rear end portion may have a width in the lateral direction which gradually increases along an entirety of the length. In some examples, the marine drive is steerable relative to the mounting plate through a steering range, wherein the width of the rear end portion at the rearmost end is wider than the marine drive throughout movement in the steering range, thereby preventing water spray onto the marine drive.

The port and starboard pontoons may further have a nose cone on the frontmost end and a dome-shaped end cap on the rearward most end. The pontoon boat may further have a deck and a mounting bracket which mounts the inner pontoon to a bottom of the deck, and L-shaped brackets which further secure the inner pontoon to the bottom of the deck, the L-shaped brackets being opposed to each other and disposed on opposite sides of the mounting bracket.

In examples, a pontoon extends from a front to a back along a longitudinal axis, from a port side to a starboard side along a lateral axis which is perpendicular to the longitudinal axis, and from a top to a bottom along a vertical axis which is perpendicular to the longitudinal axis and perpendicular to the lateral axis. The pontoon has a cylindrical body portion which longitudinally extends between a forward end and a rearward end, and a rear end portion which longitudinally extends from a frontmost end to a rearmost end, the rear end portion having a length in the longitudinal direction, a width in the lateral direction, and a height in the vertical direction, wherein as viewed in a plane defined by the lateral and vertical axes, the rear end portion gradually transitions along the length from a circular shape to a stadium shape, and wherein the height of the rear end portion remains constant along an entirety of the length. The rear end portion may comprise a planar bottom surface extending parallel to the longitudinal axis thereby providing a constant running surface in water.

BRIEF DESCRIPTION OF THE DRAWINGS

Examples are described with reference to the following drawing figures.

DETAILED DESCRIPTION

Figure 1:
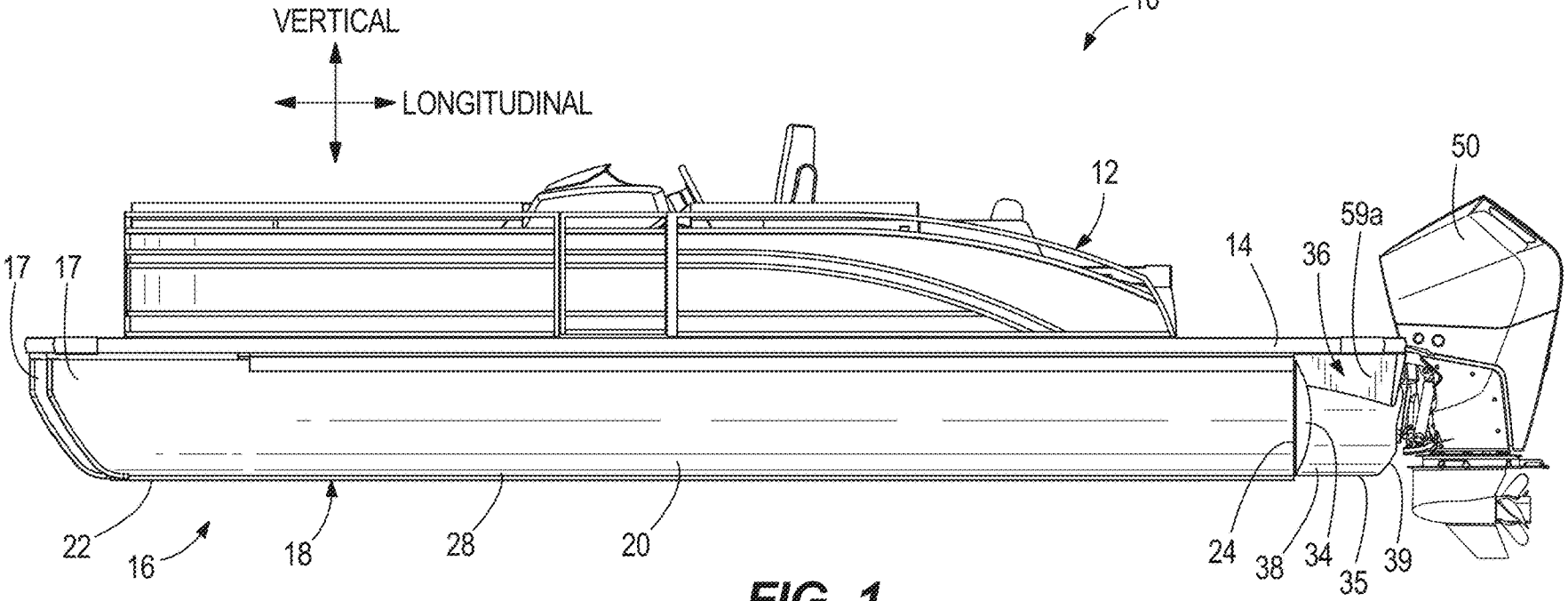
FIG. 1 is a side view of a pontoon boat configured according to an embodiment of the present disclosure.
Figure 2:
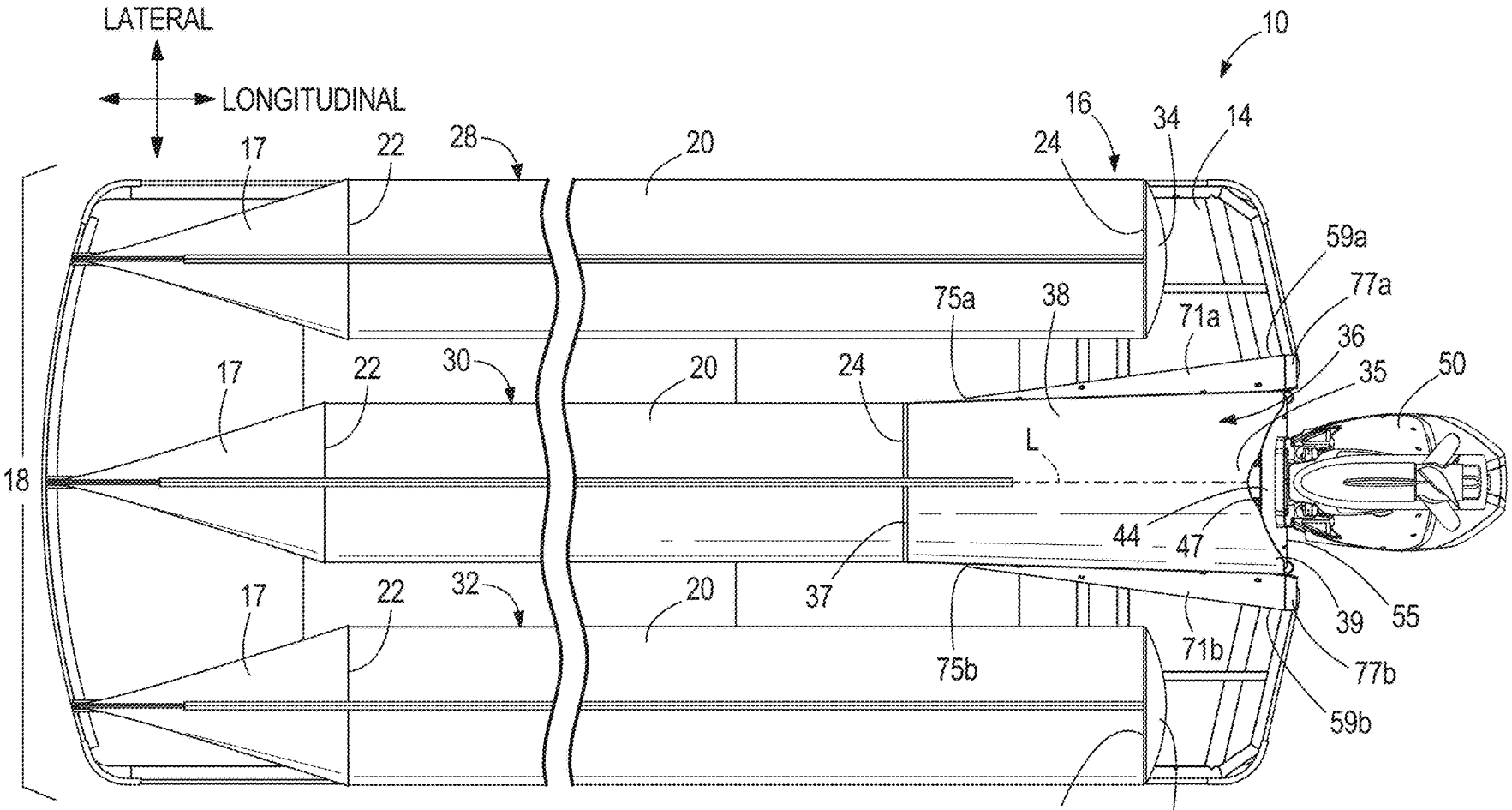
FIG. 2 is a bottom view of the pontoon boat.

FIG. 1 shows a side view of a pontoon boat 10, extending from front to back along a longitudinal axis and from top to bottom along a vertical axis which is perpendicular to the longitudinal axis. FIG. 2 shows a bottom view of the pontoon boat 10, extending from front to back along the longitudinal axis and from a port to a starboard side along a lateral axis which is perpendicular to the longitudinal axis and perpendicular to the vertical axis. The pontoon boat 10 includes an upper structure 12 having various accessories including a helm, furniture, fences, and/or the like. The upper structure 12 is mounted to a deck 14 which is supported on the water by a floatation system 16.

The floatation system 16 includes three pontoons 18, which are spaced apart laterally and extend longitudinally beneath the deck 14. The three pontoons 18 may further be defined as a port pontoon 28, a starboard pontoon 32, and an inner pontoon 30, which is located laterally between the port pontoon 28 and the starboard pontoon 32. The three pontoons 18 each include an elongated cylindrical body portion 20 having a length which extends from a forward end 22 to a rearward end 24 and a height which is constant along an entire length thereof. In the illustrated example, the cylindrical body portion 20 of the inner pontoon 30 is longitudinally shorter than the cylindrical body portions 20 of the port and the starboard pontoons 28, 32. The pontoons 18 each include a nose cone 17 which is positioned at the forward end 22 and configured to improve movement of the boat 10 through a body of water. The port and the starboard pontoon 28, 32 each include a dome-shaped end cap 34 which is positioned on the rearward end 24.

The three pontoons 18 are mounted to the deck 14 via extruded mounting brackets 26 which extend longitudinally, as shown in FIGS. 3-6. The mounting brackets 26 are welded onto either side of an upper surface of the cylindrical body portion 20 of each of the pontoons 18 and coupled to the underside of the deck 14. The mounting brackets 26 include a T-shaped track 19 for coupling to the deck 14 which extends laterally and longitudinally, a curved track 21 which extends longitudinally and vertically, and end caps 23. The curved track 21 beneficially allows the mounting brackets 26 to bend and compress under shock-load, which reduces stress being transferred onto the pontoons 18.

During research and development, the present inventors have identified that the construction of the inner pontoon 30 impacts the performance of the flotation system in operation. In the prior art, rounded profiles of the pontoons produce excessive drag and increase water spray directed toward the marine drive. Further, the inventors recognized the need for an increased transom so as to accommodate increases in the size of marine drives being mounted thereto. Accordingly, the present disclosure provides an improved inner pontoon, having a rear end portion which longitudinally extends from a frontmost end to a rearmost end, the rear end portion having a length in the longitudinal direction, a width in the lateral direction, and a height in the vertical direction. As viewed in a plane defined by the lateral and vertical axes, the rear end portion gradually transitions along the length from a circular shape to a stadium shape. To address the challenges of reducing drag and providing a laminar flow of water to the motor, the height of the rear end portion remains constant along an entirety of the length.

Figure 6:
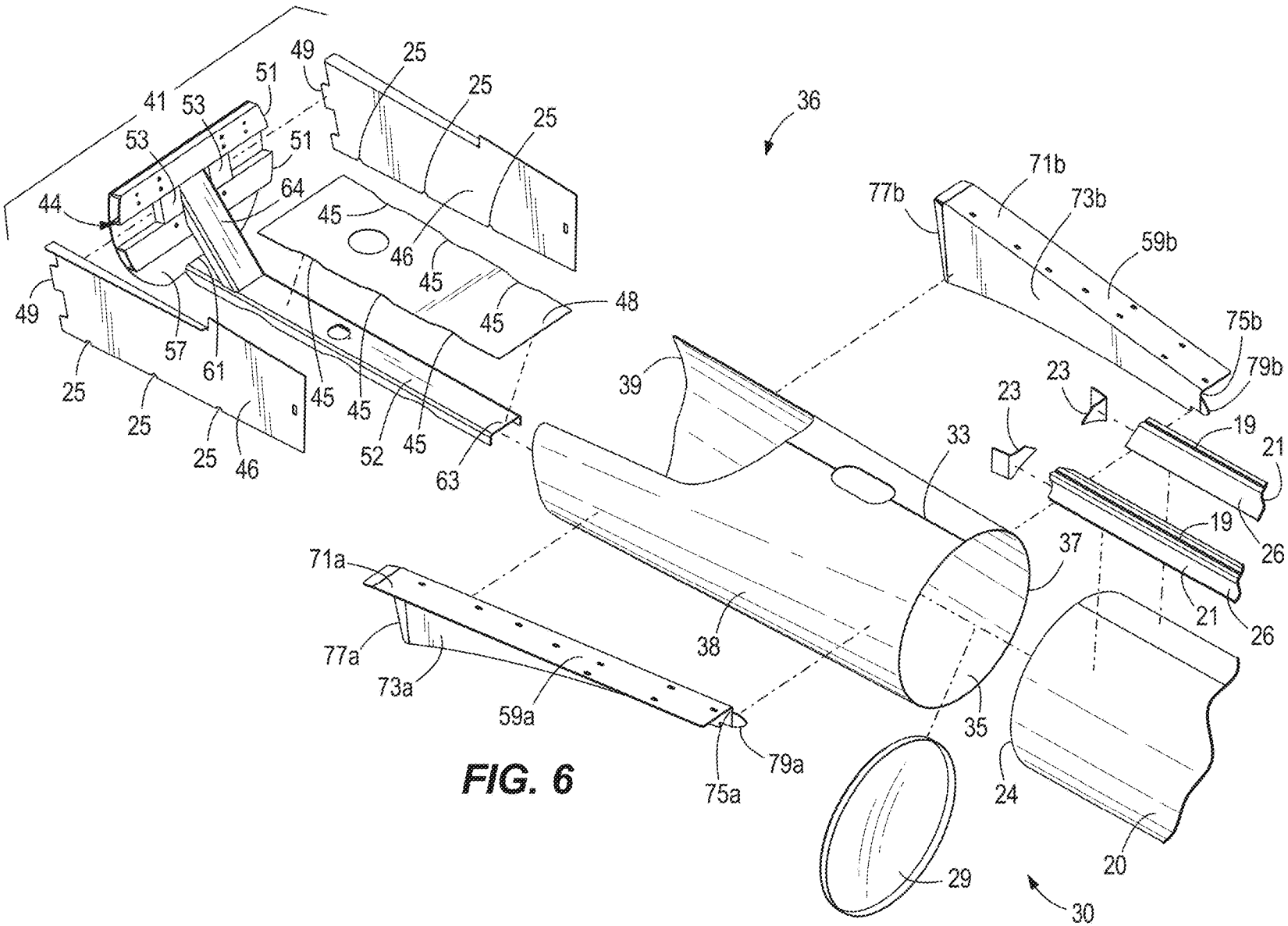
FIG. 6 is an exploded view of a rear end portion of the inner pontoon.
Figure 7:
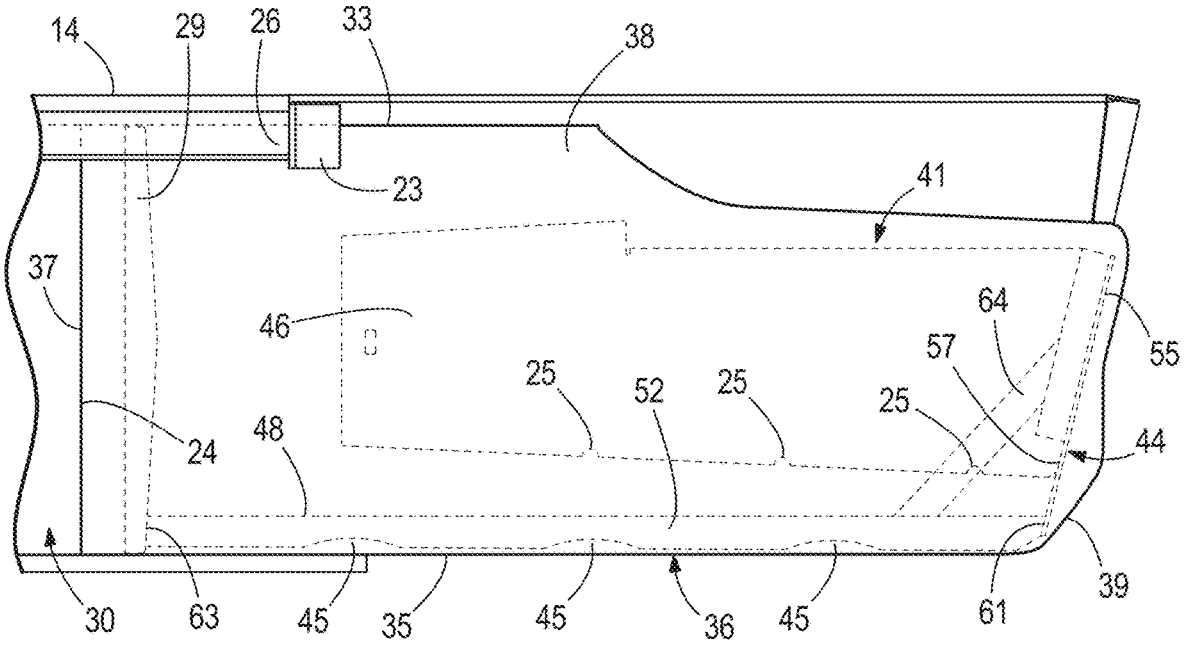
FIG. 7 is a side view of the rear end portion.

Referring to FIGS. 2 and 6, the inner pontoon 30 further includes a rear end portion 36 which is configured to support a marine drive 50. The rear end portion 36 has a top surface 33 and a planar bottom surface 35 and extends longitudinally from a frontmost end 37 to a rearmost end 39. The frontmost end 37 is closed via a circular plate 29, as shown in FIGS. 6-7, which prevents the transfer of water from the rear end portion 36 to the cylindrical body portion 20 of the inner pontoon 30. The frontmost end 37 is crimped and welded to the rearward end 24 of the cylindrical body portion 20 such that the top surface 33 and the bottom surface 35 of the rear end portion 36 are coplanar with a top surface and a bottom surface of the cylindrical body portion 20. The bottom surface 35 remains coplanar with the bottom surface of the cylindrical body portion 20 along its entire length to provide a constant running surface in water. As a result of the attachment of the rear end portion 36 to the cylindrical body portion 20, the inner pontoon 30 is longitudinally longer than and extends further rearwardly than the port and the starboard pontoons 28, 32 relative to the pontoon boat 10.

Figure 3:
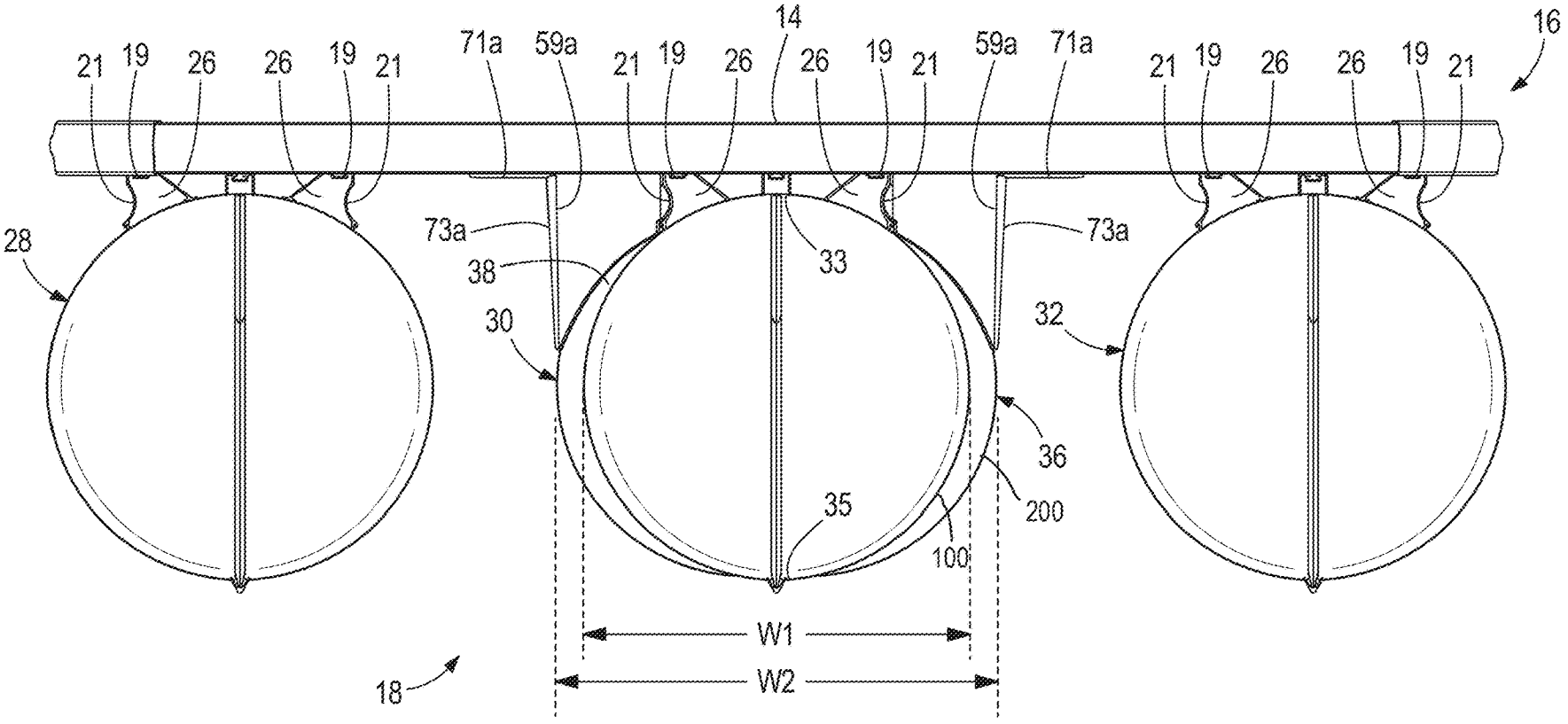
FIG. 3 is a front elevation view of the pontoon boat.
Figure 4:
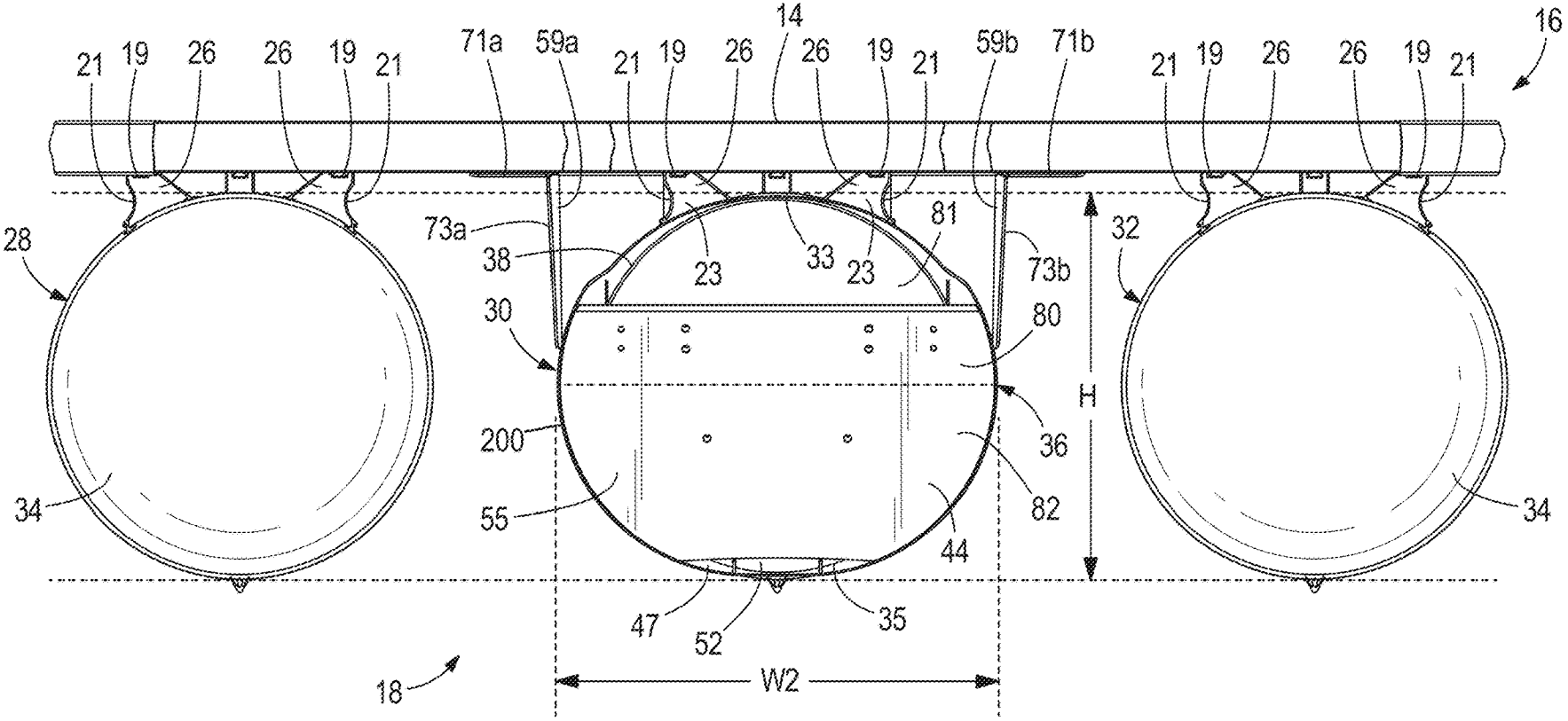
FIG. 4 is a rear elevation view of the pontoon boat.
Figure 5:
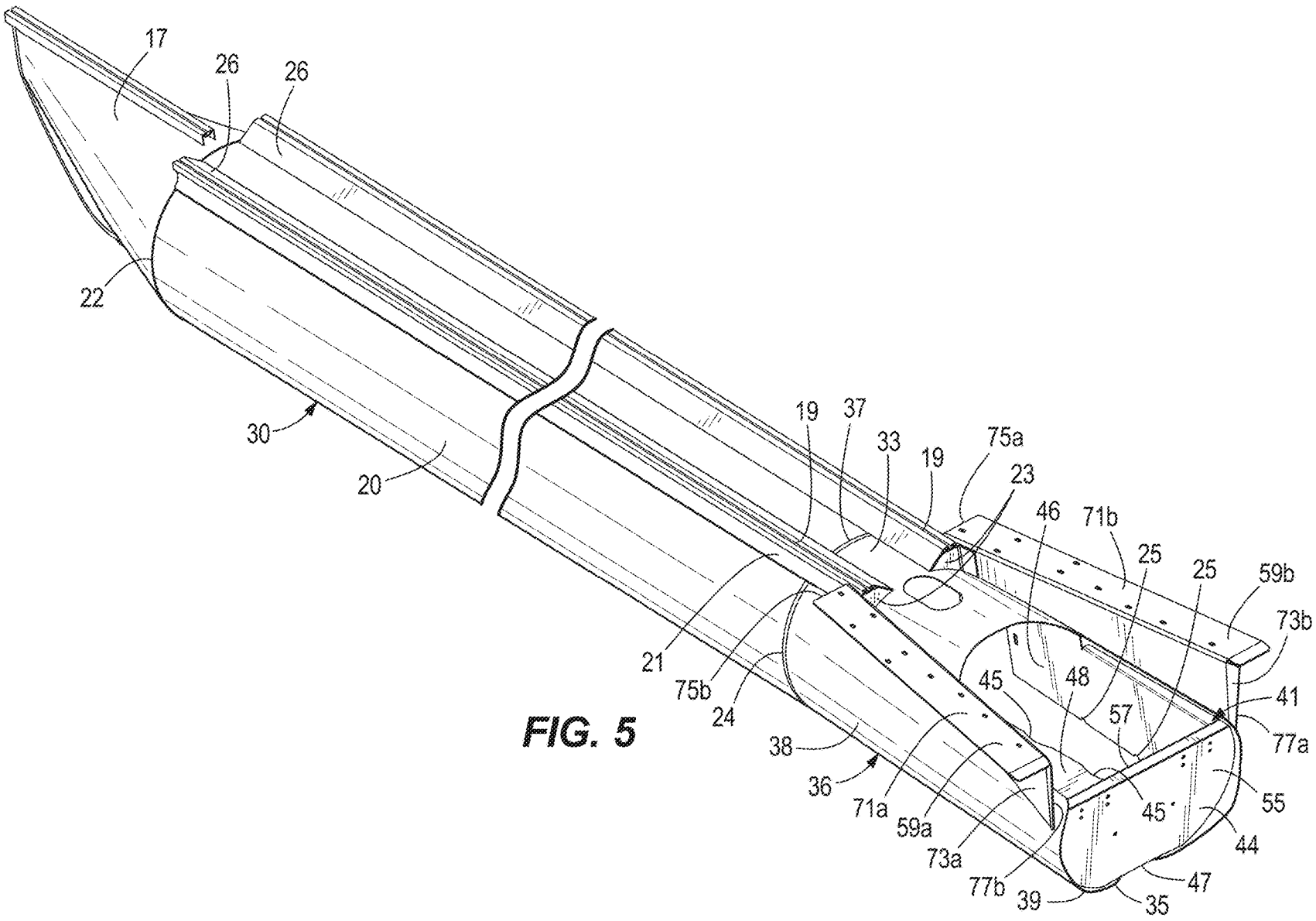
FIG. 5 is an isometric view of an inner pontoon of the pontoon boat, configured according to an embodiment of the present disclosure.

Best shown in FIG. 6, the rear end portion 36 includes a body 38, a pair of L-shaped brackets 59*a*, 59*b*, a mounting plate 44, and a reinforcement structure 41 for supporting a fuel tank (not shown) of the marine drive 50 within the body 38. The body 38 is formed of aluminum sheeting which is rolled and seamed together via welding at the top surface 33, as shown in FIG. 6. Referring to FIGS. 2-4, the body 38 has a length L along the longitudinal axis, a width W along the lateral axis, and a height H along the vertical axis. Along the entirety of the length L, the height H remains constant, while the width W gradually increases from a first width W1 to a second width W2, such that the body 38 transitions from a circular profile 100 at the frontmost end 37 to a stadium profile 200 at the rearmost end 39, as shown in FIGS. 3-4.

The body 38 is secured to the underside of the deck 14 via the L-shaped brackets 59*a*, 59*b*, which are opposed to one another and are disposed on laterally opposing sides of the mounting brackets 26 of the cylindrical body portion 20. The L-shaped brackets 59*a*, 59*b* each extend from a front end 75*a*, 75*b*, to a back end 77*a*, 77*b*. Furthermore, the L-shaped brackets 59*a*, 59*b* each include a tooth 79*a*, 79*b* positioned at the respective front ends 75*a*, 75*b*, for coupling to the mounting brackets 26. The L-shaped brackets 59*a*, 59*b* each include a first surface 71*a*, 71*b* which extends coplanar with the underside of the deck 14 on either side of the body 38. The L-shaped brackets 59*a*, 59*b* each include a second surface 73*a*, 73*b* which extend longitudinally and vertically downward from the first surface 71*a*, 71*b* adjacent the body 38 such that the L-shaped brackets 59*a*, 59*b* face laterally outward from one another. The second surfaces 73*a*, 73*b* are tapered from the back end 77*a*, 77*b* to the front end 75*a*, 75*b* and curve outward to match the gradual widening of the body 38. The second surfaces 73*a*, 73*b* are welded to laterally opposing sides of the body 38, as shown in FIG. 3-4. To provide additional mounting support, each of the teeth 79*a*, 79*b* are positioned in engagement with the curved track 21 of the mounting brackets 26, where they are secured therein via the end caps 23.

Figure 8:
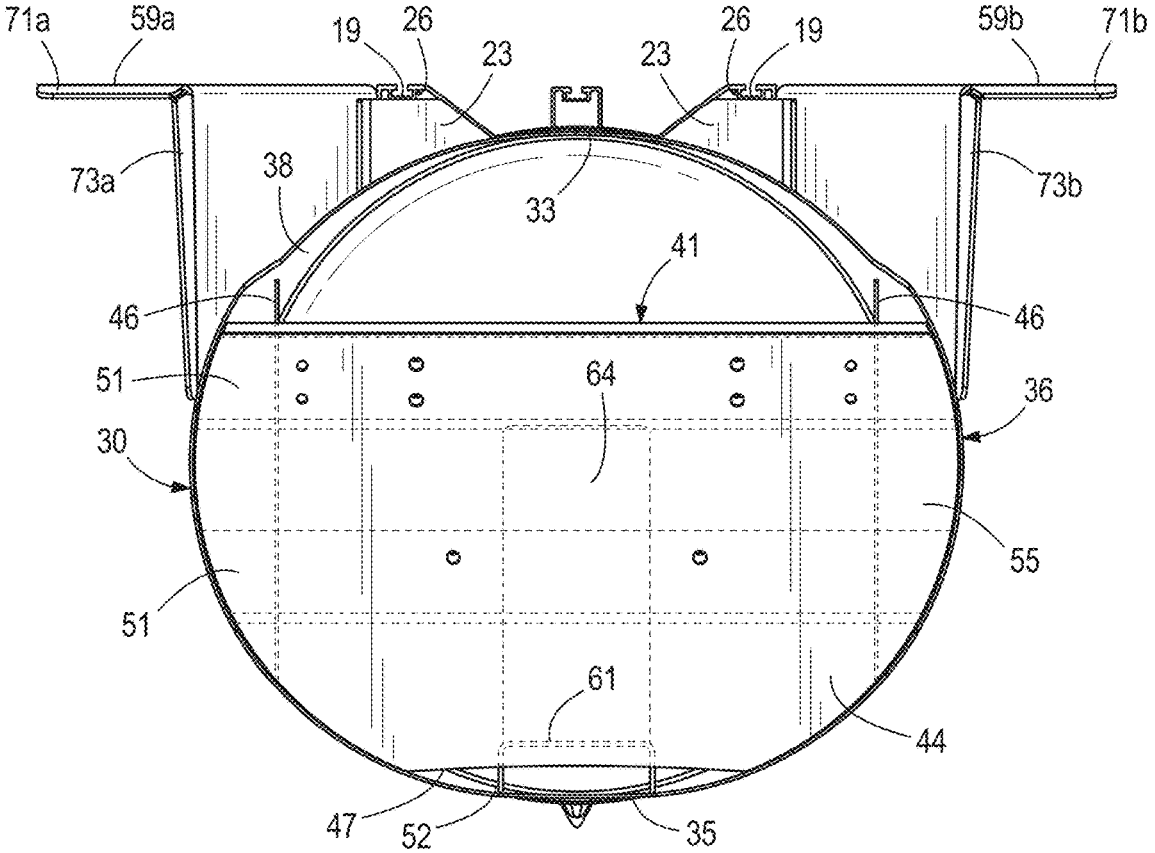
FIG. 8 is a rear elevation view of the rear end portion.

The mounting plate 44 is shaped to substantially match the profile of the stadium profile 200, as shown in FIG. 4. The mounting plate 44 is located on the rearmost end 39 of the rear end portion 36 and is configured to support the marine drive 50 for propelling the pontoon boat 10 in water. The mounting plate 44 has a top half 80 and a bottom half 82, shown in FIGS. 4 and 8. The top half 80 includes a sectional cutout 81 which provides an opening adjacent the top surface 33 of the rear end portion 36 to facilitate passage between the fuel tank and the marine drive 50. The bottom half 82 includes relief cuts 47, as shown in FIG. 8, which allow for accumulated water to flow in and out of the body 38 without undue pressure on the mounting plate 44. The mounting plate 44 has an outer face 55 upon which the marine drive 50 is supported, and an inner face 57. The inner face 57 is reinforced via welding with a pair of lateral crossbars 51 which are joined via a pair of vertical connectors 53.

Referring to FIGS. 5-8, the reinforcement structure 41 includes a pair of side plates 46, a base plate 48, and a central C-channel beam 52. The side plates 46 extend vertically and longitudinally and are secured via welding along laterally opposing sides of the body 38. The side plates 46 each have a notched end 49, shown in FIG. 6, which interlock with and are welded to the lateral crossbars 51 on the mounting plate 44 for increased structural stability. Additionally, the side plates 46 includes relief cuts 25 which allow accumulated water to flow in and out of the body 38 without undue pressure on the side plates 46.

The central C-channel beam 52 extends from a rearmost end 61 to a frontmost end 63 along the bottom surface 35 of the body 38. The rearmost end 61 is positioned adjacent the mounting plate 44 and the frontmost end 63 is positioned longitudinally forward therefrom. The C-channel beam 52 includes an angled auxiliary beam 64 which is welded to both the mounting plate 44 and the rearmost end 61, as shown in FIG. 6. In combination, the C-channel beam 52 and the auxiliary beam 64 provided load bearing support for the fuel tank. The base plate 48 provides a support surface upon which the fuel tank rests. The base plate 48 extends laterally and longitudinally within the body 38, and is welded to the central C-channel beam 52. Additionally, the base plate 48 includes relief cuts 45 which allow accumulated water to flow in and out of the body 38 without undue pressure on the base plate 48.

Figure 9:
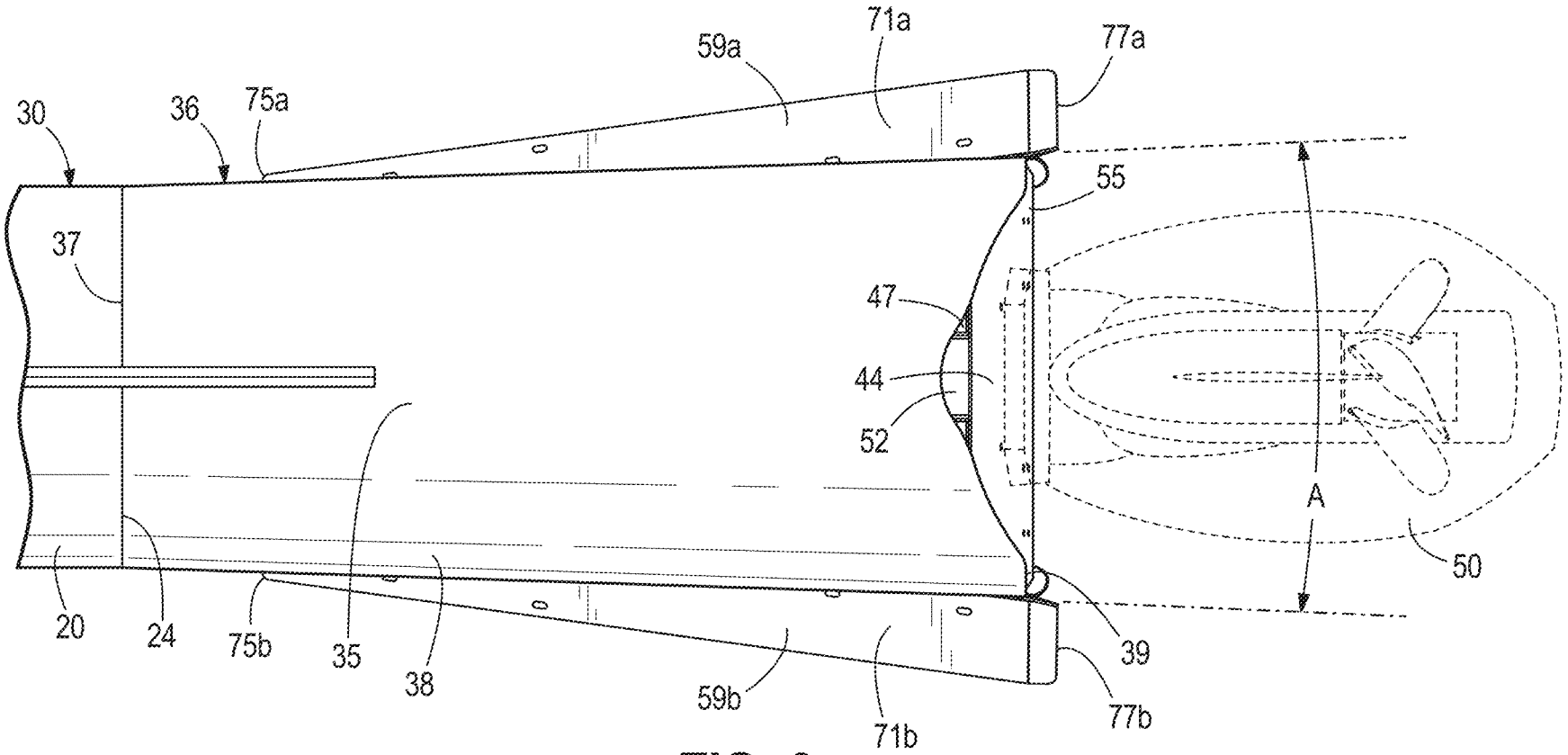
FIG. 9 is a top elevation view of the rear end portion, showing a marine drive mounted thereon.

The marine drive 50 is mounted to the mounting plate 44, where it is steerable relative to the mounting plate 44 through a steering range, shown in FIG. 9 by the arrow A. The fuel tank is supported on the base plate 48 within the rear end portion 36. The width W of the rear end portion 36 is laterally wider than the marine drive 50 throughout movement in the steering range, thereby preventing water spray onto the marine drive 50. The improved inner pontoon 30 of the present disclosure provides laminar flow of water to the marine drive 50, which improves on-plane control of the boat 10. Additionally, the taper of the rear end portion 36 from the circular profile 100 to the stadium profile 200 creates a gradual deflection of water away from the marine drive 50, thus eliminating the need for additional spray deflectors, as are used in the prior art. Furthermore, the increased width of the rear end portion 36 provides a larger mounting area to accommodate larger marine drives 50.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A pontoon boat which extends from a front to a back along a longitudinal axis, from a port side to a starboard side along a lateral axis which is perpendicular to the longitudinal axis, and from a top to a bottom along a vertical axis which is perpendicular to the longitudinal axis and perpendicular to the lateral axis, the pontoon boat comprising:

a port pontoon, a starboard pontoon, and an inner pontoon located laterally between the port pontoon and the starboard pontoon, wherein each of the port pontoon, the starboard pontoon and the inner pontoon comprises a cylindrical body portion which longitudinally extends between a forward end and a rearward end, the inner pontoon further having a rear end portion which longitudinally extends from a frontmost end to a rearmost end, the rear end portion having a length in the longitudinal direction, a width in the lateral direction, and a height in the vertical direction, wherein as viewed in a plane defined by the lateral and vertical axes, the rear end portion gradually transitions along the length from a circular shape to a stadium shape so as to deflect water aa from the inner pontoon, and wherein the height of the rear end portion remains constant along an entirety of the length so as to reduce drag and/or provide laminar flow of the water therepast.

2. The pontoon boat according to claim 1, wherein the rear end portion comprises a planar bottom surface extending parallel to the longitudinal axis thereby providing a constant running surface in water.

3. The pontoon boat according to claim 1, wherein the cylindrical body portion of the inner pontoon has a height which is constant along an entire length thereof, and wherein the cylindrical body portion of the inner pontoon and the rear end portion have bottom surfaces which are coplanar.

4. The pontoon boat according to claim 1, wherein the rear end portion has a width in the lateral direction which gradually increases along an entirety of the length.

5. The pontoon boat according to claim 1, further comprising a mounting plate located on the rearmost end of the rear end portion, the mounting plate being configured to support a marine drive for propelling the pontoon boat in water.

6. The pontoon boat according to claim 5, further comprising a marine drive mounted to the mounting plate.

7. The pontoon boat according to claim 6, wherein the rear end portion has a width in the lateral direction which gradually increases along an entirety of the length.

8. The pontoon boat according to claim 7, wherein the marine drive is steerable relative to the mounting plate through a steering range, and wherein the width of the rear end portion at the rearmost end is wider than the marine drive throughout movement in the steering range, thereby preventing water spray onto the marine drive.

9. The pontoon boat according to claim 1, wherein the port and starboard pontoons further comprise a nose cone on the frontmost end and a dome-shaped end cap on the rearward most end.

10. The pontoon boat according to claim 1, wherein the rear end portion is coupled to the cylindrical body portion of the inner pontoon.

11. The pontoon boat according to claim 1, wherein the cylindrical body portion of the inner pontoon is longitudinally shorter than the cylindrical body portions of the port and starboard pontoons.

12. The pontoon boat according to claim 1, wherein the inner pontoon is longitudinally longer than the port and starboard pontoons, respectively.

13. The pontoon boat according to claim 1, wherein the port pontoon, the starboard pontoon, and the inner pontoon each have a nose cone on the forward end of the cylindrical body of the respective port, starboard and inner pontoon.

14. The pontoon boat according to claim 1, wherein the port pontoon and the starboard pontoon each have a dome-shaped end cap on the rearward end of the cylindrical body of the respective port and starboard pontoon.

15. The pontoon boat according to claim 1, wherein the inner pontoon extends further rearwardly than the port and starboard pontoons relative to the pontoon boat.

16. The pontoon boat according to claim 1, further comprising a deck and a mounting bracket which mounts the inner pontoon to a bottom of the deck, and further comprising L-shaped brackets which further secure the inner pontoon to the bottom of the deck, the L-shaped brackets being opposed to each other and disposed on opposite sides of the mounting bracket.

17. A pontoon extends from a front to a back along a longitudinal axis, from a port side to a starboard side along a lateral axis which is perpendicular to the longitudinal axis, and from a top to a bottom along a vertical axis which is perpendicular to the longitudinal axis and perpendicular to the lateral axis, the pontoon comprising a cylindrical body portion which longitudinally extends between a forward end and a rearward end, and a rear end portion which longitudinally extends from a frontmost end to a rearmost end, the rear end portion having a length in the longitudinal direction, a width in the lateral direction, and a height in the vertical direction, wherein as viewed in a plane defined by the lateral and vertical axes, the rear end portion gradually transitions along the length from a circular shape to a stadium shape so as to defect water away from the pontoon, and wherein the height of the rear end portion remains constant along an entirety of the length so as to reduce drag and/or provide laminar flow of the water therepast.

18. The pontoon according to claim 17, wherein the rear end portion comprises a planar bottom surface extending parallel to the longitudinal axis thereby providing a constant running surface in water, wherein the cylindrical body portion of the pontoon has a height which is constant along an entire length thereof, and wherein the cylindrical body portion of the inner pontoon and the rear end portion have bottom surfaces which are coplanar.

19. The pontoon according to claim 18, wherein the rear end portion has a width in the lateral direction which gradually increases along an entirety of the length.

20. The pontoon according to claim 19, further comprising a mounting plate located on the rearmost end of the rear end portion, the mounting plate being configured to support a marine drive for propelling the pontoon boat in water.

* * * * *